US011873147B2

(12) United States Patent
Sheahan

(10) Patent No.: US 11,873,147 B2
(45) Date of Patent: Jan. 16, 2024

(54) CONTAINER WITH CHILD RESISTANT MEANS

(71) Applicant: COMPGEN LTD, London (GB)

(72) Inventor: Mark Sheahan, London (GB)

(73) Assignee: Compgen Ltd, London (GB)

( * ) Notice: Subject to any disclaimer, the term of this patent is extended or adjusted under 35 U.S.C. 154(b) by 0 days.

(21) Appl. No.: 16/975,314

(22) PCT Filed: Feb. 22, 2019

(86) PCT No.: PCT/GB2019/000033
§ 371 (c)(1),
(2) Date: Aug. 24, 2020

(87) PCT Pub. No.: WO2019/166754
PCT Pub. Date: Sep. 6, 2019

(65) Prior Publication Data

US 2021/0394979 A1 Dec. 23, 2021

(30) Foreign Application Priority Data

Feb. 27, 2018 (GB) ..... 1803224

(51) Int. Cl.
*B65D 50/04* (2006.01)
*B65D 53/02* (2006.01)
*B65D 53/04* (2006.01)

(52) U.S. Cl.
CPC ..... *B65D 50/046* (2013.01); *B65D 53/02* (2013.01); *B65D 53/04* (2013.01); *B65D 2215/06* (2013.01)

(58) Field of Classification Search
CPC .... B65D 50/046; B65D 50/041; B65D 53/02; B65D 53/04; B65D 2215/06; B65D 45/16
See application file for complete search history.

(56) References Cited

U.S. PATENT DOCUMENTS 2,772,803 A * 12/1956 Pasquariello ..... B65D 50/068 215/219
3,820,683 A * 6/1974 Jasinski ..... B65D 83/40 220/784

(Continued)

FOREIGN PATENT DOCUMENTS

DE 7831458 U1 * 7/1981 ..... B65D 83/40
DE 202012101254 U1 * 7/2012 ..... B65D 45/34

(Continued)

OTHER PUBLICATIONS

Written Opinion of the International Searching Authority, dated Jul. 16, 2019, fifteen (15) pages.

*Primary Examiner* — J. Gregory Pickett
*Assistant Examiner* — Abigail Elizabeth Guidry

(57) ABSTRACT

A container (2) with child resistant means, which container (2) comprises: (i) a body portion (4) for receiving a product; (ii) a top (6) for opening and closing the body portion (4); (iii) locking means (10) for locking the top (6) to the body portion (4); (iv) opening means for unlocking the locking means (10) and enabling the top (6) to be moved to open the body portion (4), and the container (2) being such that: (v) the locking means (10) is a push-operated locking means (10) which operates by pushing the top (6) onto the body portion (4); (vi) the opening means (19) is a squeeze-operated opening means (19) which operates by simultaneously squeezing of the top (6) at two opposed locations (19) only; and (vii) the push-operated locking means (10) and the squeeze-operated opening means (19) enable the body portion (4) to be closable and openable using only one hand on the top (6) and without having to rotate the top (6) relative to the body portion (4).

17 Claims, 5 Drawing Sheets

(56) References Cited

U.S. PATENT DOCUMENTS 3,885,712 A * 5/1975 Libit ..... B65D 83/40 222/153.14
3,885,715 A * 5/1975 Lowry ..... B65D 83/40 222/182
3,958,708 A * 5/1976 Le Brun, Jr. ..... B65D 50/046 215/216
4,130,220 A * 12/1978 McKirnan ..... B65D 50/067 220/284
D254,480 S * 3/1980 Smalley ..... D9/454
4,434,904 A * 3/1984 D'Amico ..... B65D 55/02 215/253
4,759,457 A * 7/1988 Nakayama ..... B65D 81/2015 220/4.24
4,807,786 A * 2/1989 Gueret ..... B65D 41/185 222/499
5,040,694 A * 8/1991 Gambello ..... B65D 50/062 220/915
5,609,262 A * 3/1997 Trout ..... B29C 37/0014 215/219
5,897,015 A * 4/1999 Sheahan ..... B65D 43/0212 220/780
6,105,801 A * 8/2000 Minnette ..... B65D 1/023 215/216
6,161,711 A * 12/2000 Miceli ..... B65D 50/061 215/349
6,488,165 B1 * 12/2002 Hidding ..... B65D 41/48 215/256
6,612,450 B1 * 9/2003 Buono ..... B65D 50/046 220/326
6,729,487 B1 * 5/2004 Dischler ..... B65D 41/065 215/204
7,510,102 B2 * 3/2009 Schmitt ..... B05B 15/50 222/148
7,530,470 B1 * 5/2009 Houser ..... B65D 50/046 220/915
8,205,761 B2 * 6/2012 Stull, Sr. ..... B65D 50/041 215/220
8,360,281 B2 * 1/2013 DeJonge ..... B65D 83/205 222/182
8,469,212 B2 * 6/2013 Goto ..... B65D 50/046 215/221
9,181,000 B2 * 11/2015 Yoshida ..... B65D 50/046
9,771,190 B2 * 9/2017 Piscopo ..... B65D 50/046
10,118,742 B2 * 11/2018 Paul ..... B65D 1/16
10,737,875 B1 * 8/2020 Abels ..... B65D 83/757
2003/0121877 A1 * 7/2003 Brozell ..... B65D 41/0471 215/220
2004/0155007 A1 * 8/2004 Hearld ..... B65D 41/045 215/343
2005/0121406 A1 * 6/2005 Brozell ..... B65D 41/0471 215/216
2006/0124501 A1 * 6/2006 McNeely ..... B65D 50/046 206/534
2009/0255894 A1 * 10/2009 Ravard ..... A61J 9/00 215/11.1
2010/0320168 A1 * 12/2010 Bull ..... B65D 50/046 215/219
2015/0014269 A1 * 1/2015 Gillman ..... B65D 50/041 215/217
2016/0083152 A1 * 3/2016 Eberlein ..... B65D 45/16 220/326
2019/0308778 A1 * 10/2019 Gift ..... B29C 45/1676

FOREIGN PATENT DOCUMENTS

DE 202012101254 U1 8/2012
EP 0137085 A1 * 4/1985 ..... B65D 50/046
FR 2676997 A1 * 12/1992 ..... B65D 47/242
GB 1460749 A * 1/1977 ..... A61J 11/04
GB 2279645 A * 1/1995 ..... B65D 50/046
GB 2325920 A * 12/1998 ..... B65D 43/0212
WO 2015173536 A1 11/2015
WO WO-2015173536 A1 * 11/2015 ..... A61J 11/04

* cited by examiner

CONTAINER WITH CHILD RESISTANT MEANS

This invention relates to a container with child resistant means. The container may be for a wide range of products including liquids and solids such for example as beverages, liquid pharmaceutical preparations, creams, gels, powders, tobacco, cannabis and pills. The container may also be for items of manufacture such for example as paperclips, industrial products or consumer products.

Known child resistant containers comprise a body portion for receiving the product, and a top for opening and closing the body portion. They generally require two simultaneous physical actions to be performed to unlock and open, and thereby preclude young children's access. The top is often screwed to the body portion, and this generally requires a person to simultaneously press and turn, or squeeze and turn, to open using two hands. Often these known child resistant containers not only preclude young children but also adults who may find it difficult to lock and close and/or to unlock and open. Persons with arthritis in their hands may experience difficulty and pain in screwing and unscrewing the top to and from the body portion. It may also not be convenient or possible for adults to use two hands to open and close a container. It is known that some adults will lack the strength required, or will intentionally or unintentionally not tighten the child resistant containers up enough to engage the child resistant element in order to avoid these problems. All this leaves the child resistant means compromised.

The known child resistant containers are often less hygienic than is desirable. More specifically, the top in a known child resistant container will normally screw to the body portion. The screw threads comprise crevices which are difficult to clean properly, and which can harbour germs. In addition to being unhygienic during use, the difficulty in cleaning and the ability to harbour germs cause problems if it is desired to re-use the container, rather than dispose of it after a single use.

In addition, known child resistant containers are often not user-friendly for senior persons. They invariably require a two-handed operation, for example as occurs in the screwing of the top onto the body portion lip to a certain torque to close and lock, and simultaneously pressing or squeezing the top whilst unscrewing to unlock and open. If the top is sometimes not sufficiently tightened on the body portion, it can compromise the child resistance.

It is an aim of the present invention to reduce the above mentioned problems.

Accordingly, the present invention provides a container with child resistant means, which container comprises:

a body portion for receiving a product;

(ii) a top for opening and closing the body portion;

(iii) locking means for locking the top to the body portion; and (iv) opening means for unlocking the locking means and enabling the top to be moved to open the body portion, and the container being such that:

(v) the locking means is a push-operated locking means which operates by pushing the top onto the body portion;

(vi) the opening means is a squeeze-operated opening means which operates by simultaneously squeezing the top at two opposed locations only;

(vii) the body portion has a peripheral bead which forms part of the locking means and which prevents the container being opened by squeezing the top other than at the two opposed locations;

(viii) the top has a sidewall which extends over the body portion and covers the peripheral bead of the body portion except at the two opposed locations, whereby the peripheral bead prevents the sidewall moving inwardly when the sidewall is squeezed and thus prevents the container being opened by the squeezing unless the squeezing is at the two opposed locations; and (ix) the push-operated locking means and the squeeze-operated opening means enable the body portion to be closable and openable using only one hand on the top and without having to rotate the top relative to the body portion.

The container of the present invention is advantageous in that the combination of the locking means and the opening means is able to dispense with the need for screw threads for screwing the top onto and off the body portion in order to close the body portion and open the body portion. The above mentioned disadvantages of having screw threads are thus able to be avoided. In addition, the push-operated locking means and the squeeze-operated opening means enable the body portion to be closable and openable using only one hand on the top at a indicated location, and without having to rotate the top relative to the body portion and simultaneously pressing or turning.

The container of the present invention may have a plurality of child resistant features, and which may be employed singly or in any desired combination.

Firstly, the container size may be such as to be too large for a young child to hold in their hand and be able to squeeze simultaneously at the two opposed locations, whereby access by the child to the inside of the container is prevented. The large size of the container restricts young children as their hands are too small to squeeze the top in a pincer hand motion which requires reaching to both sides of the container.

Secondly, the container may be one in which the container has regulating means for regulating the squeeze strength needed by an average man's or woman's squeeze strength. The regulating means may be a recess or other regulating formation such for example as a slot in the top. The top may be one in which the recess has two inclined sides, and in which the inclination of the two sides facilitates a smooth upwards sliding opening action due to the two sides co-operating with a bead on the body portion.

Thirdly, the container may be provided with identification means which identifies the two opposed locations where the container needs to be squeezed to be unlocked and opened. The identification means may be a moulded sign. Other types of identification means may be employed. An adult will thus be able to identify where to squeeze the lid, whereas a child will not. Furthermore, a child will typically press on just one of the two opposed locations, or anywhere around the circumference, and will thus be unsuccessful in opening the container.

Fourthly, the container may be one in which the container has no outer gaps, where the top meets the body portion. So a young child using their small fingers or teeth cannot pry open the container, whereby access by the child to the inside of the container is prevented.

The container may be one in which the locking means is a clip locking means. The clip locking means may be advantageous in that it is able to make audible sounds. One audible sound may indicate that the top has successfully been locked onto the body portion. Another audible sound may indicate that the top has been unlocked and opened from the body portion. The audible sound indicating the successful locking may be a click. The audible sound indicating the successful unlocking and opening may be a different sound, such for example as a pop. If desired, the audible sounds may be the same but they are preferably different because they then give a user a clear audible indication that the required action has been achieved. Known child-resistant containers do not have such user-informing audible sounds.

The clip locking means may comprise at least one clip formation on the top, and a bead on the body portion. The clip formation may be on the inner surface of a sidewall on the top. There may be one of the clip formations on each of two opposite sides of the top.

The clip locking means may alternatively comprise at least one abutment member on the top, and at least one recess in the body portion. In this case, the container may be one in which there is one of the abutment members on each of two opposite sides of the top, and in which there is one of the recesses in each of the two opposite sides of the body portion or a continuous recess around the body portion.

Typically, the squeeze-operated opening means operates by squeezing the top in the two opposed locations simultaneously using a pincer hand movement.

The top may be a press fit on the body portion. The body portion may have a circumferential sidewall and a groove in an outer surface of the body portion. The top may have an upper portion and a circumferential sidewall. The upper portion may be made of a plastics material such that the circumferential sidewall of the top is pressable into the groove in the outer surface, thereby to cause the top to separate from the body portion with a sliding action.

The container may have circumferential spaced portions for releasably securing the top onto a cooperating raised surface on the body portion. The releasable securing may be effected by releasable securing means in the form of a snap-in releasable arrangement.

The container may be one in which the container comprises sealing means which is such that the container seals automatically on closing. The container sealing means may be for sealing the top on the body portion. The container may be one in which pressure caused by two drafted surfaces meeting and sliding together on closing creates the sealing means. The sealing means may be such that it causes automatic sealing when the top is pressed onto the body portion and closed due to an inner surface on the top meeting under pressure an outer surface on the open end of the body portion.

The container may be one in which two mating surfaces cause the body portion open end to be splayed outwards up against an inner circumference sidewall of the top to form the sealing means. Other sealing means may be employed for example, a foil seal, or a softer plastic insert ring, a double shot in an injection moulding manufacture process for the container, or other known sealing arrangements.

The container may be one in which the container is an elliptical, oblong or square shaped container, and in which the top automatically adjusts to a set position when placing the top on the body portion.

The child resistant container may be one in which the top fits on the body portion such that there are no outer daps where the top meets the body portion when the container is closed.

The top may be circular or elliptical in plan. If desired the top may be of other shapes in plan.

Embodiments of the invention will now be described solely by way of example and with reference to the accompanying drawings in which.

Figure 1:
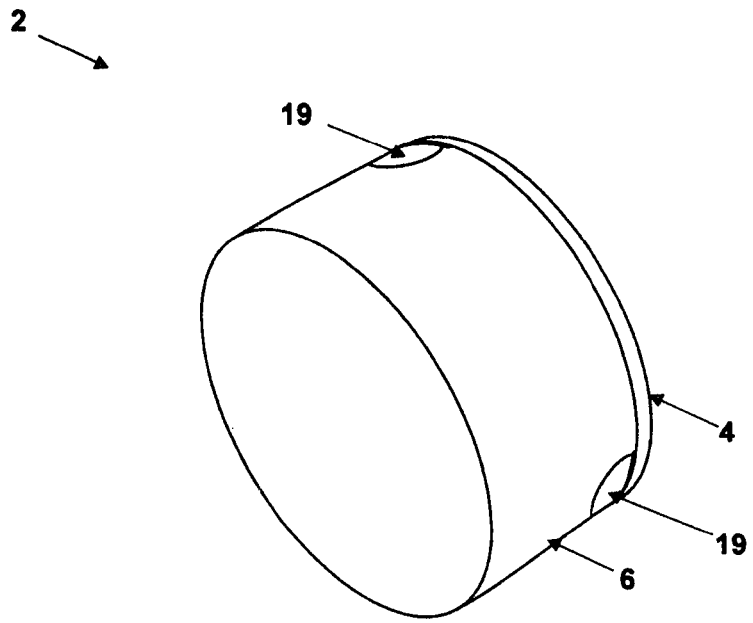
FIG. 1 is a perspective view of a first container of the present invention and one which is of a circular shape.
Figure 2:
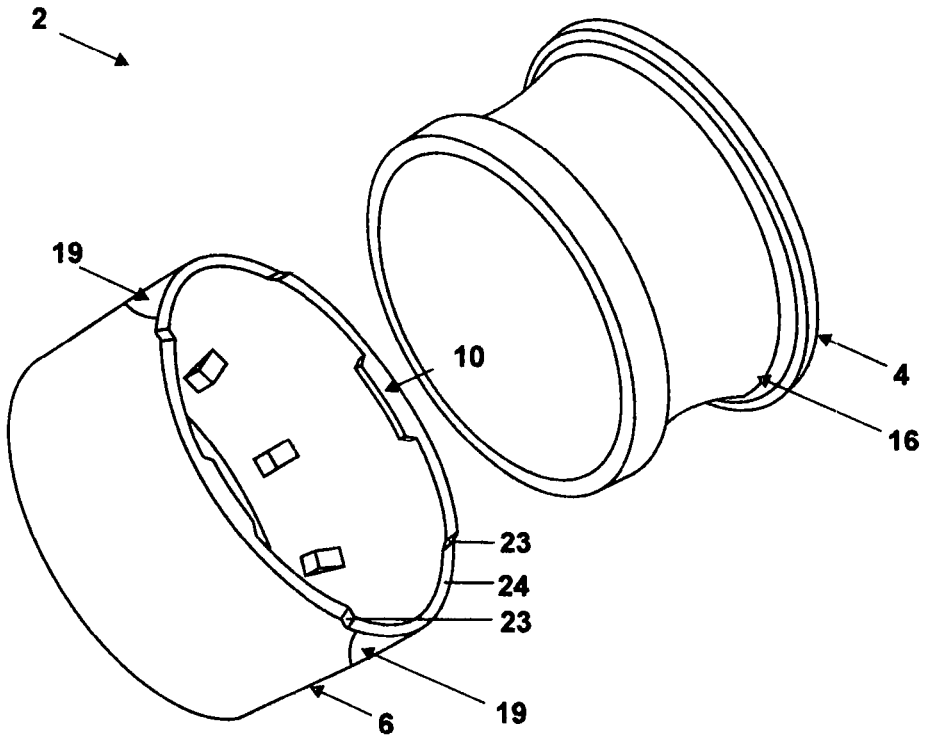
FIG. 2 is an opened view of the container's top and body as shown in FIG. 1.
Figure 3:
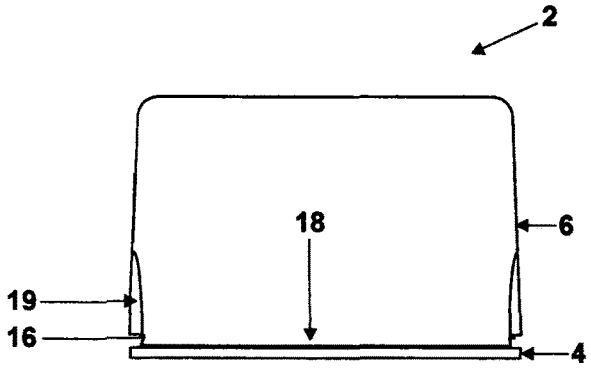
FIG. 3 is a side view of the container shown in FIG. 1.
Figure 4:
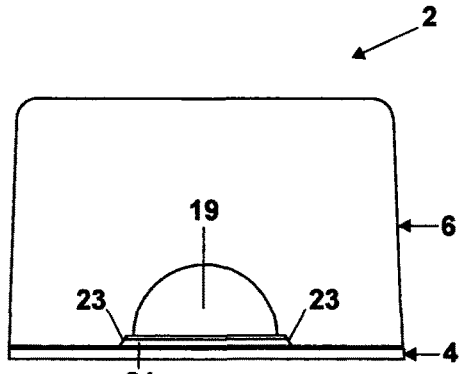
FIG. 4 is a view like FIG. 3 but rotated through 90°.
Figure 5:
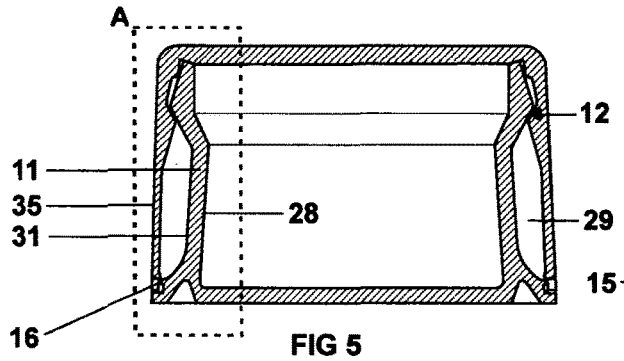
FIG. 5 is a cross section through the top part of the container as shown in FIG. 3 and with the locking means fully engaged.
Figure 6:
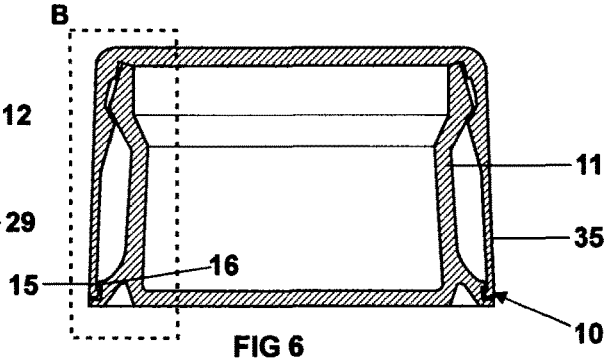
FIG. 6 is a cross section through the top part of the container as shown in FIG. 4 but rotated through 90°, and shows the locking means fully engaged.

Referring to FIGS. 1-16 and 26-27, there is shown a container 2 with child resistant means. The container 2 is circular in plan view. The container 2 comprises a body portion 4 for receiving a product. The container 2 also comprises a top 6 which is for opening and closing the body portion 4. The child resistant means for the container 2 will be appreciated from the following description.

The container 2 has locking means 10 for locking the top 6 to the body portion 4.

The container 2 also has opening means 19 for unlocking the locking means 10, and enabling the top 6 to be moved to open the body portion 4.

The container 2 is such that the locking means 10 is a push-operated locking means 10. The locking means 10 operates by pushing the top 6 onto the body portion 4.

The opening means 19 is a squeeze-operated opening means 19. The opening means 19 operates by squeezing the top 6 in a pincer hand movement at two opposing locations, i.e. at one circumferential location on each of two opposite sides of the lid.

The container 2 is such that the body portion 4 is openable and closable by a person using only one hand on the top 6. The container 2 is thus advantageous in that it is able to be operated with one hand, thereby enabling the person to open it with one hand. Still further, the container 2 is advantageous in that the locking means 10 is a push-operated locking means 10 so that the top 6 is able to be secured on the body portion 4 without screw threads. Screw threads are traditionally employed on known child resistant containers. The elimination of the screw threads eliminates a plurality of crevices which are formed by the screw threads and which can be difficult to clean and are available for harbouring germs. The germs may be any type of germs dangerous for humans, and the term "germs" is used herein broadly to cover all germs, infections, bacteria and viruses etc. likely to be found on a known child resistant container. The elimination of the screw threads may also simplify the tooling required for the manufacture of the container 2. Furthermore, moulding cycle speeds may be increased, and moulding tools may require less maintenance.

Figure 24:
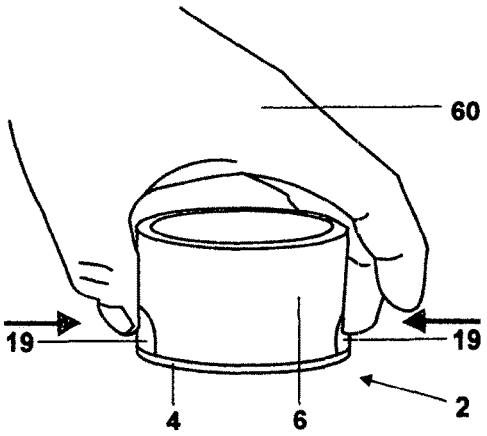
FIG. 24 is a perspective view of a third container and one which is of a circular shape in an adult's hand.
Figure 25:
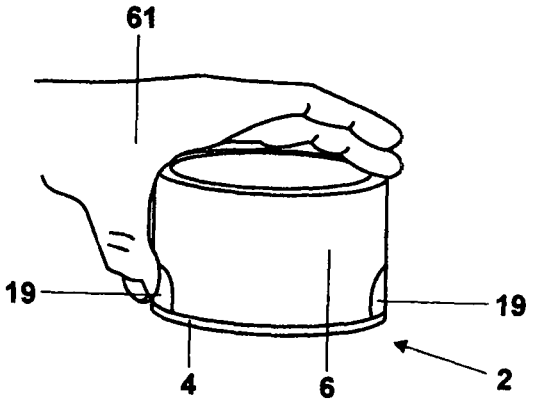
FIG. 25 is a perspective of the third container and one which is of a circular shape in a young child's hand.

Referring to FIGS. 24 and 25, the size of the container 2 is such that an adult's hand 60 can reach both locations forming the opening means 17 on the top 6, simultaneously to squeeze the container 2 open. The size of the container 2 is such that a young child's hand 61 cannot reach both locations forming the opening means 19 on the top 6, simultaneously to squeeze the container 2 open.

The locking means 10 is a clip locking means 10. The clip locking means 10 comprises at least one clip formation 14 on the top 6, and a bead 16 on the body portion 4 as shown in FIGS. 2, 3, 6 and 8.

As can be appreciated from FIGS. 3-13, there are two of the clip formations 14, with one of the clip formations 14 being on each of two opposite sides of the top 6. Each clip formation 14 is on the inner surface of a sidewall 18 on the top 6.

The body portion 4 has a neck 28. The top 6 fits over the neck 28. Referring to FIGS. 11, 13, 14, 15 and 16, it will be seen that the container 2 has ramps 39 which are smooth in construction in order to prevent a build-up of dirt and/or germs, and which can also easily be thoroughly cleaned. The ramps 39 are shown as circular ramps but they may be of other shapes if desired, for example square or oblong.

Referring now to FIGS. 17-23, there is shown a second container 30 with child resistant means. The container 30 is elliptical in plan. Similar parts as in the container 2 have been given the same reference numerals for ease of comparison and understanding.

In the container 30, the locking means 10 is a clip locking means 10 and it comprises at least one abutment member 32 on the top 6, and at least one recess 34 formed in the outer surface of the neck 28 of the body portion 4. There is one of the abutment members 32 on each of two opposite sides of the top 6. There is one of the recesses 34 on each of the same two opposite sides of the body portion 4. Each recess 34 has an upper wall portion 36 over which the abutment members 32 clip.

In use, the containers 2, 30 are operated to provide two different facilities. One facility is that of locking and unlocking. The other facility is that of opening and closing.

With regard to the facility of locking and unlocking, the locking is due to the fact that each clip formation 14 on the inner surface of the sidewall 18 on the top 6 has a draft angle 13 which corresponds with a similar draft angle 15 on the bead 16 on the body portion 4. When the elliptical shaped container 30 top 6 is pressed down onto the body portion 4, the top 6 automatically aligns to the base 4 elliptical shape which ensures abutment members 32 on the top 6 and upper wall portion 36 on the body portion 4 are opposite each other. The draft angle 13 on the top 6 meets the draft angle 15 on the bead 16 of the container 2 or the upper wall portion 36 of the container 30 on the body portion 4. This enables the two draft angles 13, 15 to meet and clip over each other. The top 6 is locked on to the body portion 4 by the flat side 17 of inner sidewall 18 on the top 6, and the flat side 23 of the bead 16 on the body portion 4 meeting and preventing the top 6 from moving upwards on the base 4 to open.

Figure 9:
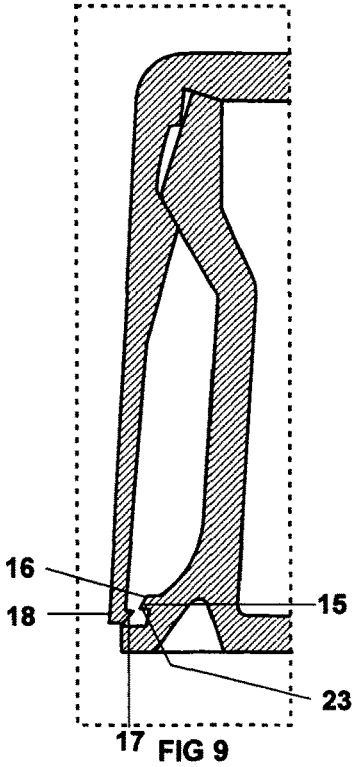
FIG. 9 is an enlarged view like FIG. 8, and shows the locking means having been released due to the top being squeezed.
Figure 10:
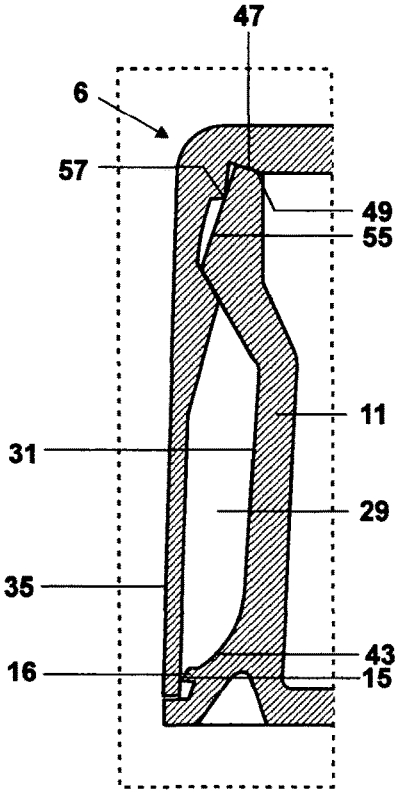
FIG. 10 is an enlarged view of the part "B" shown in FIG. 6 but rotated through 45°.
Figure 11:
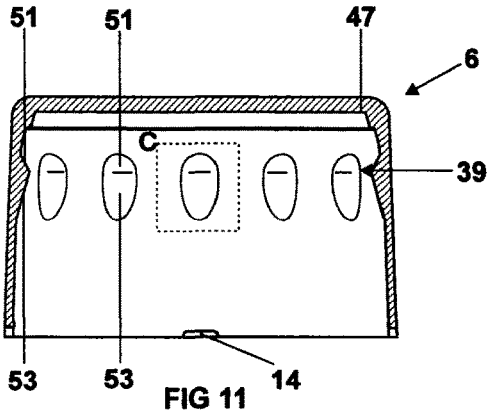
FIG. 11 is a cross section through a top.
Figure 12:
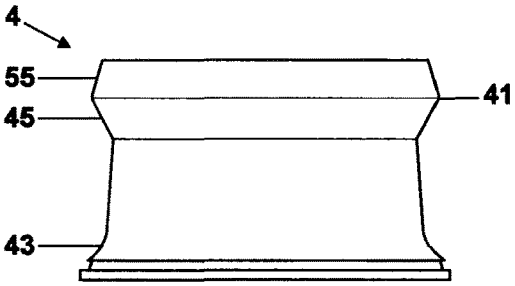
FIG. 12 is a side view of the neck part only of the body portion as shown in FIG. 6.
Figure 13:
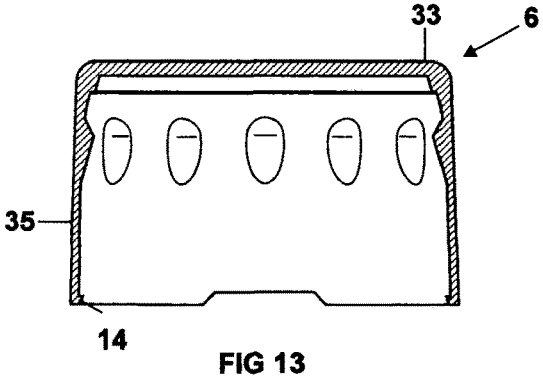
FIG. 13 is a cross section like FIG. 11 but rotated through 90°.
Figure 14:
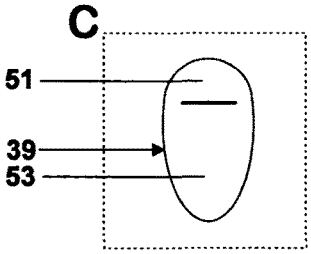
FIG. 14 shows the part "C" shown in FIG. 11 and illustrates a circular ramp.
Figure 15:
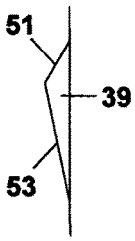
FIG. 15 is a side view of the circular ramp as shown in FIG. 14.
Figure 16:
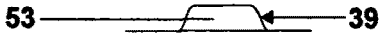
FIG. 16 shows the part "C" shown in FIG. 11 and illustrates a top side view of the circular ramp as shown in FIG. 14.
Figure 17:
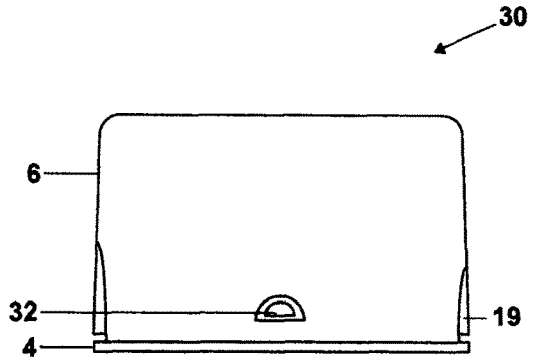
FIGS. 17 and 18 are views like FIGS. 3 and 4 but show a second child resistant container of the present invention, and one which is of an elliptical shape.
Figure 18:
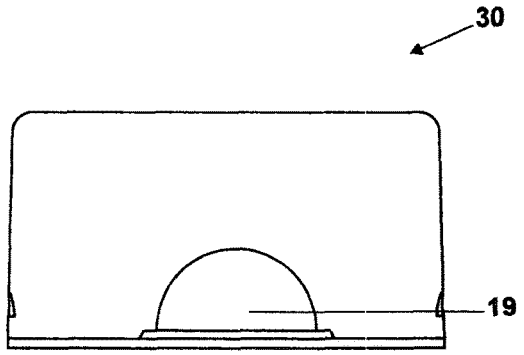

With regard to the facility of locking and unlocking, the top 6 is unlocked by simultaneously squeezing the sides of the top 6 at the two opposite locations 19. The side walls 21 move inwardly into the recess 34 of the body portion 4. This distortion of the side walls 21 will flare the opposing side walls outwards at the position of the inner sidewall 18 of the top 6, allowing the flat side 17 of inner side wall 18 on the top 6 and the flat side 23 of the bead 16 on the body portion 4 to part. The top 6 can then move upwards on the body portion 4, as shown in FIG. 9, to open the container 2, 30.

With regard to the facility of opening and closing, the top 6 is a press fit on the body portion 4. The body portion 4 has a circumferential sidewall 11 and a groove 29 in an outer surface 31 of the sidewall 11. The top 6 has an upper portion 33 and a circumferential sidewall 35. Each container 2, 30 is such that the sidewall 35 of the top 6 overlaps the sidewall 11 of the body portion 4 when the top is on the body portion 4, as best shown in FIGS. 5, 6, 7, 8, 19 and 20. The body portion 4 and the top 6 are both made of a plastics material. The body portion 4 may be made of other materials such for example as glass, wood or a metal. The body portion 4 and the top 6 are of a thickness such that the sidewall 35 of the top 6 is pressable into the groove 29 in the outer surface 31 of the sidewall 11 of the body portion 4. This is in order to cause the top 6 to separate from the body portion 4 with a sliding action. During the sliding action, the raised surface 41 slides over the part 45 on the body portion 4 to be released from the side 51 of the circumferential spaced portions 39 on the top 6.

With regard to the facility of unlocking, the top 6 is unlocked by squeezing the sides of the top 6 at the two opposite locations 19 simultaneously. Squeezing sidewalls of the top 6 other than at the opposite locations 19 will not unlock the container, as the sidewall 35 of the top 6 overlaps the bead 16 of the body portion 4 and will not engage with the draft side 43 on the body portion 4 to force the top 6 away from the body portion 4. As best appreciated from FIG. 10, the sidewall 35, other than the unlocking adjacent areas 19 of the top 6, will when squeezed press against the bead 16 on body portion 4, prevent the top 6 sidewall 35 from movement and therefore unlocking.

As can be best seen from FIGS. 2, 4, 7 and 13, the recess 24 is defined by two sides 23 on the open end of the top 6. The length of the recess 24 forms regulating means for regulating the squeeze strength needed by an average man's or woman's squeeze strength. The length of the recess helps to control the flexibility of the sidewall 35 at the opening means locations 19 on the top 6. The squeezing pressure required to deform sidewall 35 at the opening means 19 location and engage with the draft side 43 on the body portion 4 to force the top 6 away from the body portion 4 and unlock the container 2, 30, is able to be regulated and synchronized to suit an average man's or woman's squeeze strength. As shown, the two sides 23 of the recess 24 are inclined. This inclination facilitates a smooth sliding opening action due to the two sides 23 co-operating with the bead 16 on the body portion 4.

Figure 7:
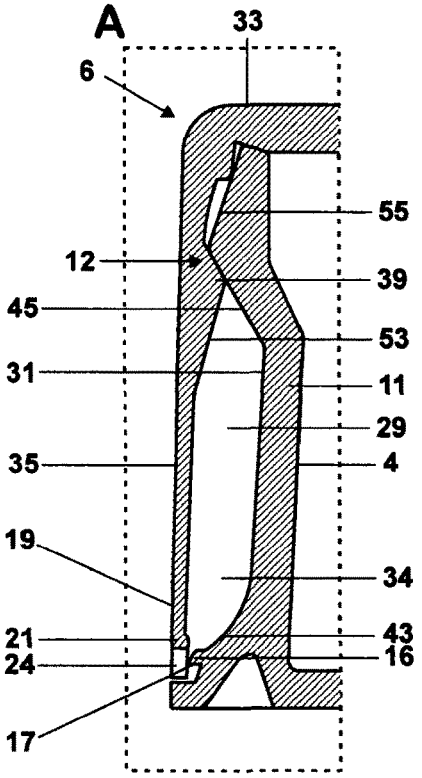
FIG. 7 is an enlarged view of the part "A" shown in FIG. 5.
Figure 8:
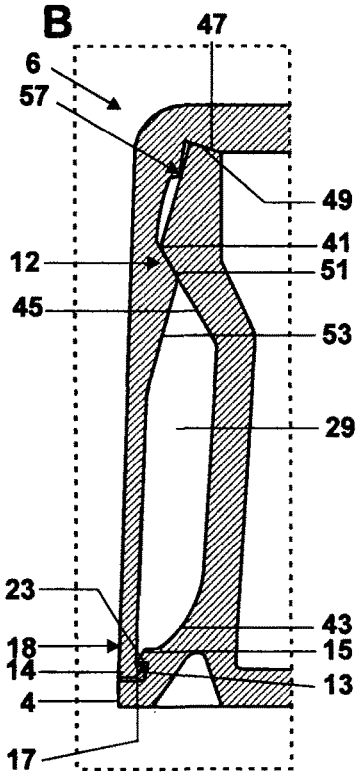
FIG. 8 is an enlarged view of the part "B" shown in FIG. 6.
Figure 19:
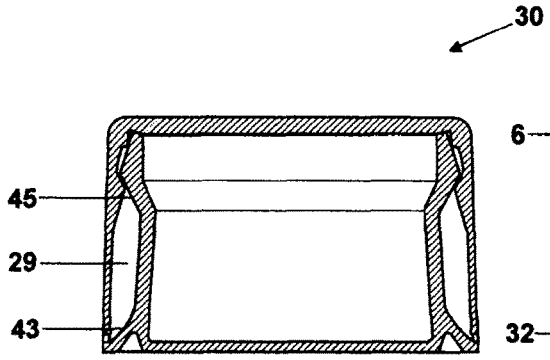
FIG. 19 is a cross section through the top part of the child resistant container as shown in FIG. 17.
Figure 20:
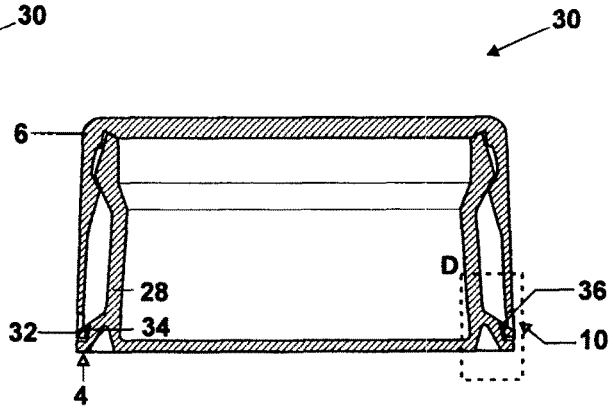
FIG. 20 is a cross section through the top part of the child resistant container as shown in FIG. 18.
Figure 21:
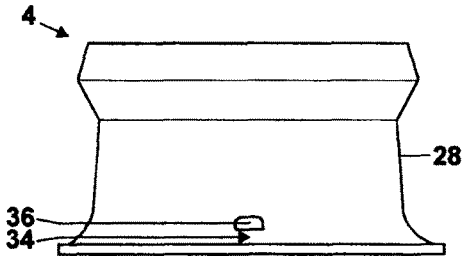
FIG. 21 is a side view of the neck part only of the body portion as shown in FIG. 19.
Figure 22:
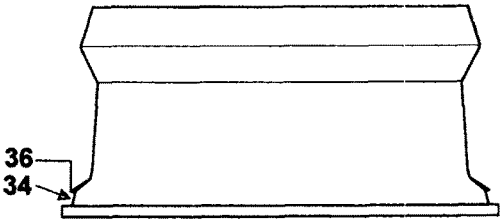
FIG. 22 is a side view of the neck part only of the body portion as shown in FIG. 20.
Figure 23:
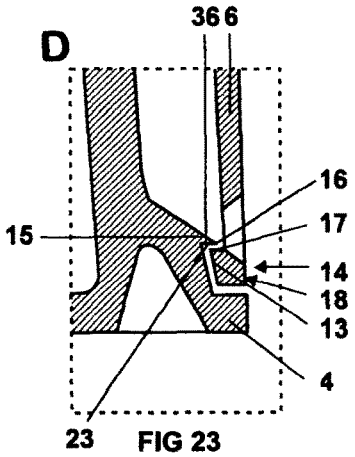
FIG. 23 is an enlarged view of the part "D" shown in FIG. 20.

As can best be seen from FIGS. 7, 8 and 19, the groove 29 is defined by a pair of sides 43, 45. The side 43 is the side of the groove 29 nearest the bottom of the body portion 4. This side 43 is a concave side. However, if desired, the side 43 could also be a flat side, but angled in relation to the sidewall 35 on the top 6. The side 43 engages the sidewall 35 of the top 6 and forces the top 6 away from the body portion 4 as the sidewall 35 of the top 6 is pressed at the locations 19 into the groove 29 of the body portion 4.

With regard to the facility of opening and closing, the closing is effected when the top 6 is pressed onto the body portion 4. More specifically, when placing the top 6 on the body portion 4, the sidewall 53 on the spaced portions 39 of the top 6 rests against the sidewall 55 of the body portion 4. When downward pressure is applied to the surface 33 of the top 6 to effect closing of the containers 2, 30, the sidewalls 53, 55 slide over each other and are captured as a snap over fit by the side wall 51 on the spaced portions 39 of the top 6 and the sidewall 45 of the body portion 4.

The containers 2, 30 comprise sealing means for sealing the top 6 on the body portion 4. More specifically, the containers 2, 30 are such that sealing occurs automatically when the top 6 is closed due to the drafted surface 47 on the open end of the top 6 meeting under pressure the drafted surface 49 on the open end of the body portion 4, causing the outer sidewall 55 to splay outwards and push against the inner edge 57 of the top 6. The surfaces 55, 57 form the main sealing means. The two surfaces 55, 57 meet under a constant pressure caused by the two drafted surfaces 47, 49 meeting and sliding together under a constant pressure caused by the top-engaging part 51 of the circumferential spaced portions 39 of the top 6 and the defined side 45 in the groove 29 of the body portion 4, sliding together and being retained.

It is to be appreciated that the embodiments of the invention described above with reference to the accompanying drawings have been given by way of example only and that modifications may be effected. Thus, for example, the body portion 4 may be longer or shorter than shown. As shown in the drawings, the top 6 is circular in plan. However, the top 6 may be of other shapes, for example elliptical as shown in the container 30 with child resistant means. Providing the top 6 and the neck 28 of the body portion 4 are of complementary connecting shapes, the remainder of the body portion 4 can be of any suitable and appropriate cross section, including circular, oval, elliptical, square, rectangular, octagonal or other multi-sided formations as required. The body portion 4 can also be of any required suitable length. The sealing means may be other than those shown. Individual components shown in the drawings are not limited to use in their drawings and they may be used in other drawings and in all aspects of the invention. The invention also extends to the individual components mentioned above and/or shown above, taken singly or in any combination.

The invention claimed is:

1. A container with child resistant means, which container comprises:

(i) a body portion for receiving a product;

(ii) a top for opening and closing the body portion;

(iii) locking means for locking the top to the body portion; and (iv) opening means for unlocking the locking means and enabling the top to be moved to open the body portion, and the container being such that:

(v) the locking means is a push-operated locking means which operates by pushing the top onto the body portion;

(vi) the opening means is a squeeze-operated opening means which operates by simultaneously squeezing the top at two opposed locations only;

(vii) the body portion has a peripheral bead which forms part of the locking means and which prevents the container being opened by squeezing the top other than at the two opposed locations;

(viii) the top has a sidewall which extends over the body portion and covers the peripheral bead of the body portion except at the two opposed locations, whereby the peripheral bead prevents the sidewall moving inwardly when the sidewall is squeezed and thus prevents the container being opened by squeezing unless the squeezing is at the two opposed locations; and (ix) the push-operated locking means and the squeeze-operated opening means enable the body portion to be closable and openable using only one hand on the top and without having to rotate the top relative to the body portion.

2. A container according to claim 1 in which the container has regulating means for regulating the squeeze strength.

3. A container according to claim 2 in which the regulating means is a recess in the top.

4. A container according to claim 3 in which the recess has two inclined sides, and in which the inclination of the two sides facilitates a smooth upward sliding opening action due to the two sides co-operating with an outer bead on the body portion.

5. A container according to claim 1 and including identification means which identifies the two opposed locations where the container needs to be squeezed.

6. A container according to claim 1 in which the locking means is a clip locking means.

7. A container according to claim 6 in which the clip locking means comprises at least one clip formation on the top, and the bead or recess on the body portion.

8. A container according to claim 7 in which the clip formation is on the inner surface of a sidewall on the top.

9. A container according to claim 7 in which there is one of the clip formations on each of two opposite sides of the top.

10. A container according to claim 6 in which the clip locking means comprises at least one abutment member on the top, and at least one recess in the body portion.

11. A container according to claim 10 in which there is one of the abutment members on each of two opposite sides of the top, and in which there is one of the recesses in each of the two opposite sides of the body portion or a continuous recess around the body portion.

12. A container according to claim 1 in which the container comprises sealing means which is such that the container seals automatically on closing.

13. A container according to claim 12 in which pressure caused by two drafted surfaces meeting and sliding together on closing creates the sealing means.

14. A container according to claim 12 in which the sealing means is a foil seal, a softer plastic insert ring, or a double shot in an injection moulding manufacturing process for the container.

15. A container according to claim 1 in which the container is an elliptical shaped container, and in which the top automatically adjusts to a set position when placing the top on the body portion.

16. A container according to claim 1 in which the top fits on the body portion such that there are no outer gaps where the top meets the body portion when the container is closed.

17. A container according to claim 1 which the top is circular or elliptical in plan.

* * * * *